343-700 MS AU 256 EX
2/16/82 OR 4,316,194

United States Patent [19]

De Santis et al.

[11] 4,316,194

[45] Feb. 16, 1982

[54] HEMISPHERICAL COVERAGE MICROSTRIP ANTENNA

[75] Inventors: Charles M. De Santis, Neptune; John R. Wills, Ocean Grove, both of N.J.

[73] Assignee: The United States of Americal as represented by the Secretary of the Army, Washington, D.C.

[21] Appl. No.: 209,809

[22] Filed: Nov. 24, 1980

[51] Int. Cl.[3] ..... H01Q 13/10; H01Q 1/28
[52] U.S. Cl. ..... 343/700 MS; 343/846
[58] Field of Search ..... 343/700 MS, 829, 830, 343/846, 847, 769, 767, 853

[56] References Cited

U.S. PATENT DOCUMENTS 4,089,003 5/1978 Conroy ..... 343/700 MS
4,218,682 8/1980 Frosch et al. ..... 343/700 MS

*Primary Examiner*—David K. Moore
*Attorney, Agent, or Firm*—Nathan Edelberg; Jeremiah G. Murray; Michael C. Sachs

[57] ABSTRACT

A single antenna having hemispherical coverage with circular polarization at very low axial ratio is disclosed. Its pancake structure comprises two stacked microstrip antennas, one atop the other, each fed phase shifted in relation to the other.

Used as transmitter or receiver antenna, it replaces conventional hemispherical types with an extremely compact and relatively inexpensive device.

9 Claims, 5 Drawing Figures

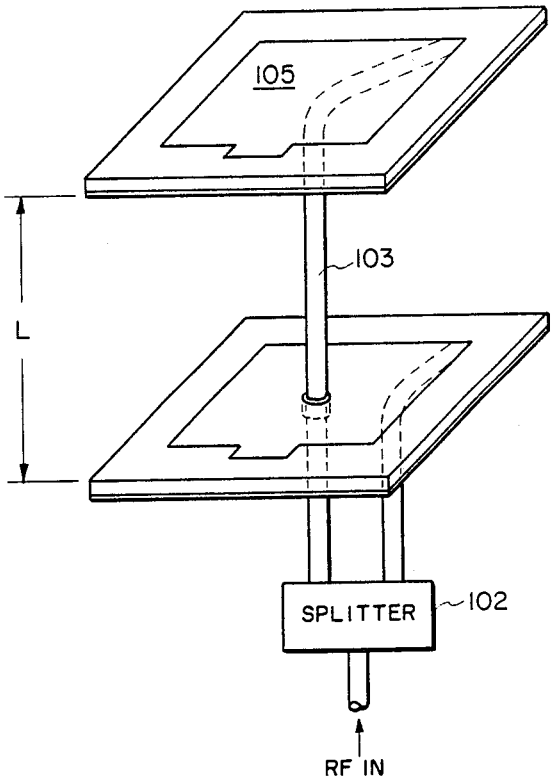
FIG. 1 PAIRED MICROSTRIP ANTENNA
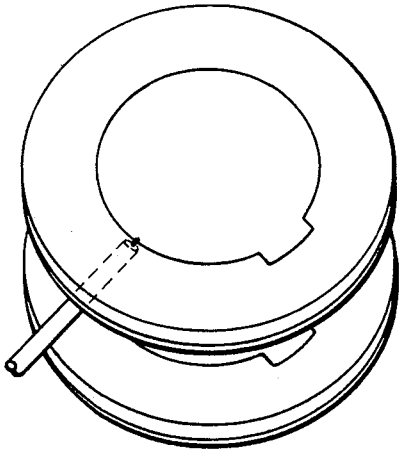
FIG. 4 SPACED CIRCULAR PATCHES
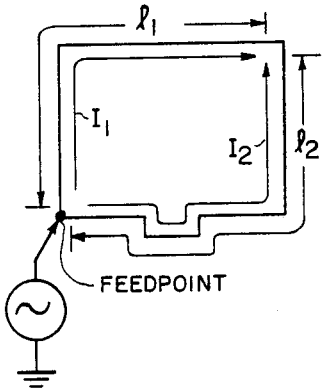
FIG. 3 CORNER FED PATCH
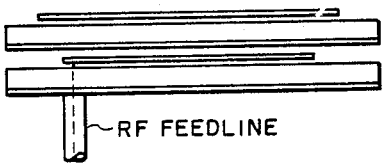
FIG. 5 DIELECTRIC ELEMENT WITH PARASITE PATCH

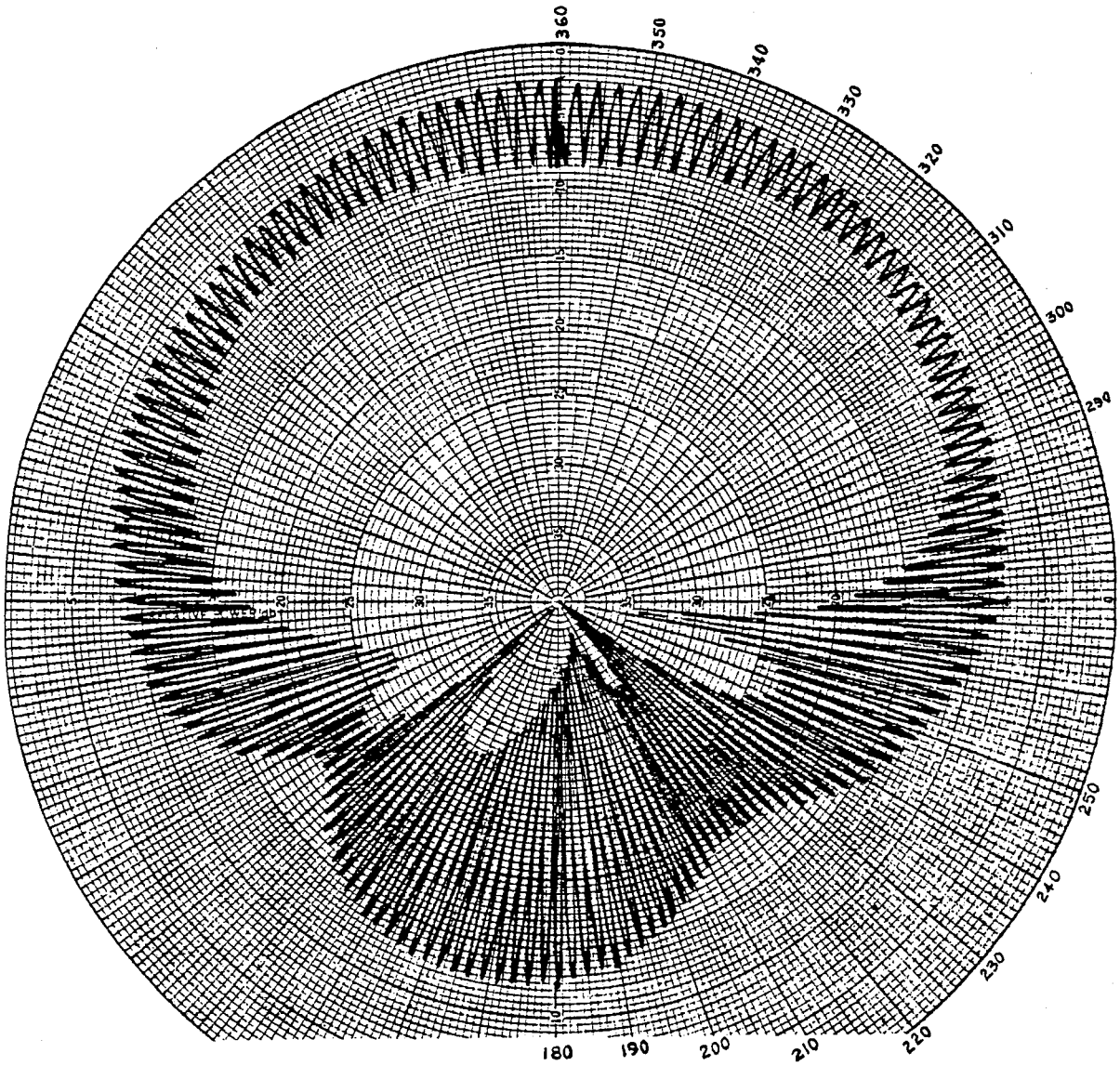
OdBI = -7.8 dB
*FIG. 2* HEMISPHERICAL, STACKED ANTENNA PATTERN.

HEMISPHERICAL COVERAGE MICROSTRIP ANTENNA

The invention described herein may be manufactured and used by or for the Government for governmental purposes, without the payment of any royalties thereon or therefor.

BACKGROUND AND FIELD OF USE

Various types of antennas exist which provide hemispherical coverage, yet they are quite complex and/or expensive. Such types include the conical spiral plus helix, quadrifilar helix, bent turnstile, and spherical types. The need is felt for spherical coverage antennas which have reduced weight, are less expensive of manufacture, and are as compact as possible. While these qualities are always welcomed, they are most especially of value in the fields of satellite navigation, communications, and for the Army G.P.S. navigation systems, for instance. In these fields of use, the light weight and compactness is of utmost importance.

BRIEF DESCRIPTION OF THE INVENTION

The invention makes use of a pair of relatively inexpensive microstrip antennas, stacked one behind the other, and fed by coax, with the outer, or upper antenna coax fed through a hole in the center of the inner, or lower one. The two are fed alike except that phase shifting must be applied on one coax line in order to achieve a radiated pattern which would have circular polarization. With proper spacing between the microstrips, and possible dielectric medium in between, phase shifting between the lines, and attenuation on the lines if needed, circular polarization with hemispherical coverage may be achieved. In transmitting, a hybrid splitter circuit may be used to properly feed, phase shift, and attenuate the lines from a single source; when the antenna is used as a receiver, the hybrid circuit becomes a combiner to attenuate, phase shift and combine the received portions of the signal. Various geometric configuration microstrips may be used with success, and various materials may be substituted, to achieve these desired results. Because of the availability of relatively expensive microstrips, the antenna array of this invention may be manufactured at low cost using, for example, printed circuit technology.

OBJECTS AND BRIEF DESCRIPTION OF FIGURES

Accordingly, one of the objects of this invention is the provision of relatively low cost antennas capable of hemispherical coverage with circular polarization.

Another object is the provision of light weight and more compact antennas having the same mentioned features.

Still another object is to provide a more nearly uniform hemispherical, circularly polarized, pattern than is presently available in standard antennas within a low cost range.

Other objects and advantages of this invention will be readily understood by those skilled in the art through reference to the following specification and attached figures in which:

FIG. 1 is a diagram of a stacked microstrip antenna pair according to the invention;

FIG. 2 is an illustration of the hemispherical, circularly polarized geometric pattern which may be propagated from a stacked microstrip antenna pair;

FIG. 3 illustrates a method of feeding the microstrip patch with current paths chosen for establishing a circularly polarized radiation pattern;

FIG. 4 shows stacked circular patches, with dielectric medium between, used to propagate circularly polarized waveforms; and FIG. 5 shows a single antenna consisting of a microstrip antenna element and a top patch being parasite, providing a broadened bandwidth, this antenna being used in pairs to produce a broad banded stacked antenna.

DESCRIPTION OF A PREFERRED EMBODIMENT OF THE INVENTION

FIG. 1 depicts a stacked antenna pair according to this invention. Each element may contain, for instance a rectangular copper patch, a half wavelength $\lambda/2$ length on each side, 0.002 of an inch thick, where $\lambda$ is the reduced free space wavelength. The plate is mounted on a dielectric which might be teflon material, $\frac{1}{8}$" thick, for instance. The patch in this example is square except for having a discontinuity, and corner fed. However, it might be circular instead, or some other geometrical shape. The dimensions of the patch seem more important in fact than its geometry. It is well to mention that the dielectric and ground plane must be of larger area than the patch to avoid having the field excite the wires behind the plane. The plates are separated by a space of some 6.3 cm in this example, which is of the order of one fourth of a wavelength $\lambda/4$, which is in the 1.0 to 2.0 GHZ frequency range. As will be discussed later, this spacing may be all the more shortened by additionally providing dielectric material having a dielectric constant greater than air between the mounted elements. This enables maintenance of the same phase relationship by readjusting feedline phase, yet shrinking the size of an element pair. The amplitude and phase of the radiated pattern may be affected by the geometry of the patch perimeter, however, a small hole in the patch seems to have little effect. In a single patch, in order to produce a circularly polarized pattern covering a 90° to 120° sector of a hemisphere, a coaxial line is fed to a corner of the patch. As will be explained later, the different path lengths for the currents around the perimeter of the patch, largely produce the conditions for propagation of this type pattern, particularly when the length of a side is $\lambda/2$ for a patch in free space. The formula $\lambda/2\sqrt{\epsilon}$, where $\epsilon$ is the dielectric constant of the dielectric medium, gives the approximate length of a side when the patch is mounted on a dielectric. Other methods of feeding the patch for circular polarization are possible, but the corner feed is one of the simplest. The above-mentioned planar antenna comprised of pairs would provide the desired hemispherical coverage with uniform gain over 180° at a very low axial ratio, which result might otherwise necessitate use of much larger and more complex antennas. Since a single plane (planar) antenna, only provides 90° to 120° coverage, the stacked pair is used, as explained further below.

As will be discussed, the antenna of this invention tends to have a narrow bandwidth of 1 to 3% deviation around a center frequency which is the resonant frequency of the patch. To broaden this deviation to 8–10%, a pancake structure might be used. A parasite plate would be added to provide multiple resonances and thereby accomplish this spread. By properly spacing this parasite, two distinct resonances can be created at frequencies such as 1.2 GHZ and 1.5 GHZ, for example. Too, with the multiple center frequencies, one is still operating with circular polarization. In the transmitting mode of this antenna pair, a splitter circuit 102 is used to adjust the phase difference between the feed signals of the two elements. In the receiver mode for use of this antenna pair, the splitter becomes a combiner. Suitable devices for this application are available from Narda, Merimac, or Weinschel Engineering Companies, for instance, as will be familiar to those skilled in the art. A rigid coax of small diameter (103) may be used to feed (and support) both elements at the desired spacing; though other methods might also be used.

It is well to note that there is an upper limit on the amount of spacing possible between the patches and this is $\lambda/2$, a half wavelength. Exceeding this amount results in a directed beam and poor circular polarization. The polarization in this experiment is actually elliptical approaching circular, though described as circular.

In FIG. 2, the radiation pattern is shown for the two antennas of FIG. 1 placed 6.3 cm apart and operated at 1.6 GHZ. Even though the spacing may be calculated through physical forumlas, in practice it is best determined experimentally. Similarly, patch dimensions, including patch thickness, and thickness of dielectrics, resonant frequency of the antenna and the like may all be calculated through formulas, but these quantities are best approached through experimental adjustments. General teachings on calculating such quantities might be found in a text on circular polarization by Edward C. Jordan and Keith G. Balmain entitled "Electromagnetic Waves and Radiating Systems", second edition (Prentice-Hall), for instance. One should note that with little exception, the pattern provides uniform hemispherical coverage with approximate circular polarization at uniform gain (ODB-IC). The axial ratio is seen to be of the order of 5 dB over the whole upper hemisphere which indicated that an appropriate phase shift in one of the antenna feed lines was needed to improve the ratio. This might be accomplished by lengthening or shortening one of the feed lines, or through the addition of a phase shifter, as explained earlier.

In FIG. 3, illustration is provided of RF current paths around the perimeter of a patch when a corner of the patch is fed and when a discontinuity is included in one path so that the path lengths are unequal. This type discontinuity introduces the 90° phase shift required to produce circularly polarized radiation from the patch.

The design dimensions of the individual patch antennas can be found approximately from the following equation:

$$f = \frac{c}{2d\sqrt{\epsilon_r}},$$

where f is the desired operating frequency; d is the length of one side of the square patch; and $\epsilon_r$ is the relative dielectric constant of the medium supporting the patch.

The thickness of antennas used in one experiment was 0.125" teflon dielectric with copper clading of 0.002" thickness. The feed line for each antenna was attached at one corner of the patch. Electrically, this produced two possible current paths along the patch edges (see FIG. 3). If the electrical lengths of the two paths are adjusted such that the phase difference $\Delta\phi$ is 90°, i.e.

$$\phi_1(l_1) = \beta l_1;$$

$$\phi_2(l_2) = \beta l_2;$$

$$\Delta\phi = \beta(l_2 - l_1) = 90°$$

where $$\beta = \frac{2\pi f}{c}\sqrt{\epsilon_r}$$

where f is the operating frequency, c is the velocity of light in vacuum and $\epsilon_r$ is the relative dielectric constant of the supporting medium, then the conditions for launching a circularly (elliptically, in general) polarized wave from the patch are established. Proper phase compensation further lowers the axial ratio of the stacked antenna for circular polarization.

While square patch antennas are shown, a circular patch design (see FIG. 4) is also possible, and has been tested with similar success. The diameter of the circle should be approximately $\lambda/2$ in free space or $\lambda/2\sqrt{\epsilon}$ when mounted on a dielectric medium with a constant of $\epsilon$. The tab (or feedpoint) location can be moved to obtain either right or left hand polarization as desired.

Alternate patch geometries and feed arrangements are possible. For either the square or round patch, two feed points located on the same radius but 90° apart, can be used on each antenna. These ports must be fed through a 90° hybrid coupler for circular polarization; and the input of each 90° hybrid is fed from the power splitter, as done before. The dual-fed arrangement provides more freedom for adjusting the amplitude and phase of each feedpoint to achieve an optimized radiation pattern, but the adjustments are much more complicated and tedious.

By placing a low loss dielectric material, such as plastic foam or Teflon between the two patch antennas, the overall spacing between the antennas can be reduced for the same performance, thus reducing the overall package size. Using this technique, however, requires proper phase and amplitude adjustment of the antennas for proper operation.

It is possible to broaden the impedance bandwidth of the patch antennas by adding a parasite patch above the driven patches or patch (see FIG. 5). According to this mode, the parasite patch is not driven. Successful broadbanding is accomplished using a parasite patch on a teflon spacer. In one example, the parasite patch radius is ~ 10% larger than the driven patch radius; the thickness of the teflon layer was 0.125". This produced an antenna with a bandwidth of ~ 5 to 6% of the center frequency. By varying the spacing of the parasite, useful operation can be obtained at two distinct frequencies, separated by as much as 30% of the active patch resonant frequency. Note that a wide variety of configurations are possible using a single parasite element per patch. When several parasites are used, the antenna pattern becomes more directive. For the present device, this is undesirable because wide hemispherical coverage, not directivity, is the aim.

While the invention has been described above with reference to certain figures, it should be recognized by those skilled in the art that many modifications and substitutions in embodying the invention can be made within the spirit of the specification and appended claims.

What is claimed is:

1. An antenna having hemispherical coverage with circular polarization comprising:

two or more patch units positioned plane parallel, stacked, with space between less than a half wavelength each patch unit comprising a thin metallic patch having at least one discontinuity in the symmetry of its perimeter, the patch mounted on a larger sized plane of metal-backed dielectric material, feedlines each connected to a patch on the patch units, a phase delay device in one of said feedlines, whereby the patches are driven from the same source with proper phasing of one line and a hemispherical pattern with circular polarization is propagated from said antenna structure.

2. The antenna of claim 1 used as a receiving antenna wherein the feedlines are combined, instead of being driven from a source, with proper phasing of one line, to form a received signal.

3. The antenna of claim 1 wherein a dielectric medium is disposed in the space between the patch units.

4. The antenna of claim 1, 2 or 3 wherein each patch is symmetrically rectangular with a tab discontinuity in one of its sides.

5. The antenna of claim 1, 2 or 3 wherein each patch is symmetrically circular with a tab discontinuity in its perimeter.

6. The antenna of claim 2 wherein a dielectric medium is disposed in the space between the patch units.

7. The antenna of claim 1 or 2 wherein one or more of the patch units is an inactive parasite patch unit, to broaden the bandwidth of the antenna.

8. The method of propagating a circularly polarized field with hemispherical coverage comprising the steps of:

positioning two patch units in plane parallel position, stacked, with less than half wavelength separation distance, each patch unit having a metallic patch on a metal-backed dielectric plane, and driving each patch from a common source with one patch feed being phase delayed with respect to the other.

9. The method of claim 8 adapted for receiving wherein the signals received at each patch are combined, not driven, one phase delayed, forming a common received signal.

* * * * *